US005514037A

United States Patent [19]

Downey, Jr.

[11] Patent Number: 5,514,037

[45] Date of Patent: May 7, 1996

[54] MODULAR PASSIVE SMOKE VENTILATION SYSTEM

[76] Inventor: Joseph E. Downey, Jr., 4703 Webster St., Bladensbury, Md. 20710

[21] Appl. No.: 212,831

[22] Filed: Mar. 15, 1994

[51] Int. Cl.[6] ..... F24F 7/10

[52] U.S. Cl. ..... 454/345; 454/49

[58] Field of Search ..... 55/385.8, 467, 55/471; 454/49, 56, 67, 230, 232, 234, 341, 343, 345

[56] References Cited

U.S. PATENT DOCUMENTS

| | | | |
|---|---|---|---|
| 4,094,256 | 6/1978 | Holper et al. | 108/50 |
| 4,378,727 | 4/1983 | Doss . | |
| 4,625,633 | 12/1986 | Martin . | |
| 4,647,295 | 3/1987 | Christ | 454/341 X |
| 4,942,805 | 7/1990 | Hellwig et al. . | |
| 4,974,915 | 12/1990 | Bussard | 454/230 X |

FOREIGN PATENT DOCUMENTS

| | | | |
|---|---|---|---|
| 4-161547 | 6/1992 | Japan | 454/306 |

*Primary Examiner*—Harold Joyce
*Attorney, Agent, or Firm*—Alfred Hoyte

[57] ABSTRACT

A modular enclosure acts in combination with a ventilation system to prevent passive smoke from spreading to an adjacent area. The enclosure is designed in accordance with the traditional workstation configuration. A plurality of panels form a partial enclosure about a desk. The desk has a top surface with front and side edges having perforated conduits attached thereto. The inner surfaces of the panels also have perforated conduits attached thereto. These perforated conduits are attached to a main conduit whereby a suction is applied for exhausting air therefrom.

1 Claim, 6 Drawing Sheets

MODULAR PASSIVE SMOKE VENTILATION SYSTEM

BACKGROUND OF THE INVENTION

The present invention relates to a ventilation system and more particularly to a modular ventilation system which can be employed to prevent the spread of passive smoke to an adjacent area.

The inhalation of passive smoke by non-smokers in public places has recently been discovered to be a serious health hazard. In response to this health hazard, numerous federal, state, and local ordinances and restrictions have been promulgated. The most restrictive of these ordinances mandates a complete ban on smoking in all indoor facilities open to the public, which ban includes restaurants and bars, places where smokers have become quite accustomed to having some freedom to smoke. These local ordinances tend to have a devasting effect on the local economy since the smoking patrons will usually simply go to the nearest county or township that allows smoking in public places.

In the office environment, the restrictions on smoking are typically so extensive that smokers are usually relegated to the restrooms or to a location completely outside of the office building, places where the typical worker cannot perform his or her job.

Accordingly, it would be desirable to provide a solution to the passive smoke problem that would be convenient for everyone, smokers as well as non-smokers.

SUMMARY OF THE INVENTION

It is an object of this invention to provide a modular ventilation system effective to prevent the spread of passive smoke to an adjacent area.

It is another object of this invention to provide a modular ventilation system which can effectively purify air which contains passive smoke so that it can be ventilated outdoors or recirculated back into the indoor environment.

It is another object of the invention provide a modular ventilation system effective to prevent the spread of passive smoke which can be used in large open spaces.

It is yet another object of the invention to provide a modular ventilation system effective to prevent the spread of passive smoke in various types of office environments.

These and other objects of the invention are accomplished by providing a modular enclosure which acts in combination with a ventilation system to prevent passive smoke from spreading to an adjacent area. The enclosure includes wall sections which have a base portion and a transparent upper portion. The base portion has air intake vents disposed near to the floor. The transparent upper portion is used to control the drifting of passive smoke to an adjacent area while still allowing persons inside of the enclosure visual access to the area outside of the enclosure. A plurality of ceiling mounted ventilation ports are disposed above the enclosure, the ventilation ports being connected to a corresponding network of ducts. A blower system acts in combination with the ducts, ports, and air intake vents to effectively prevent passive smoke from drifting outside of the enclosure walls.

DETAILED DESCRIPTION OF THE INVENTION

Figure 1:
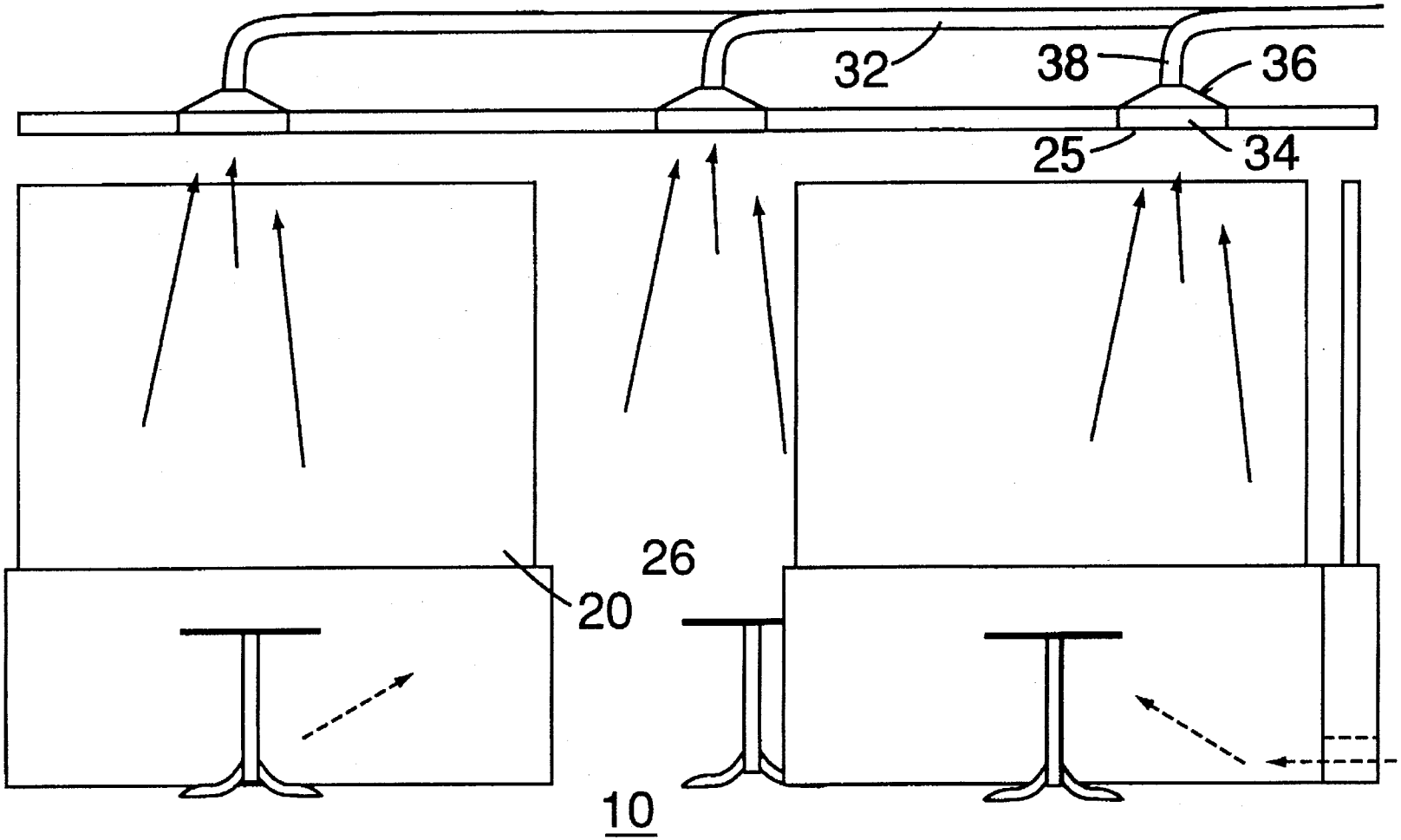
FIG. 1 is a front view of the enclosure of the first embodiment, including a cross section of the ceiling, ventilation ports and duct arrangment.

Referring now to FIG. 1 a front view of the enclosure 10 is shown. A typical application for this type of enclosure 10 would be in a restaurant or other public place where large numbers of people are seated at tables. The enclosure 10 includes modular wall sections 20, the wall sections 20 having a transparent upper portion 22, and a base portion 24. The upper portion 22 serves to keep passive smoke from drifting to an adjacent area, effectively guiding the smoke towards ventilation ports 25, which are mounted in the ceiling 23 above the enclosure 10 area.

The wall sections 20 are placed so as to define an isolated area to be designated as a smoking section or area. Since the upper portion 22 of the wall sections 20 are transparent the smoking section is not "cut off" from the rest of the room. Thus the enclosure 10 can be readily integrated with the existing decor. Of course an opening 26 is provided to allow access to the smoking section. It is not necessary that a door be provided to contain passive smoke since typically patrons will not be seated or standing in the opening 26. It should be noted that the existing walls can be used with the wall sections 20 to enclose the smoking section. It can be readily apprectiated that a corner placement will minimze the need for wall sections 20.

Figure 2:
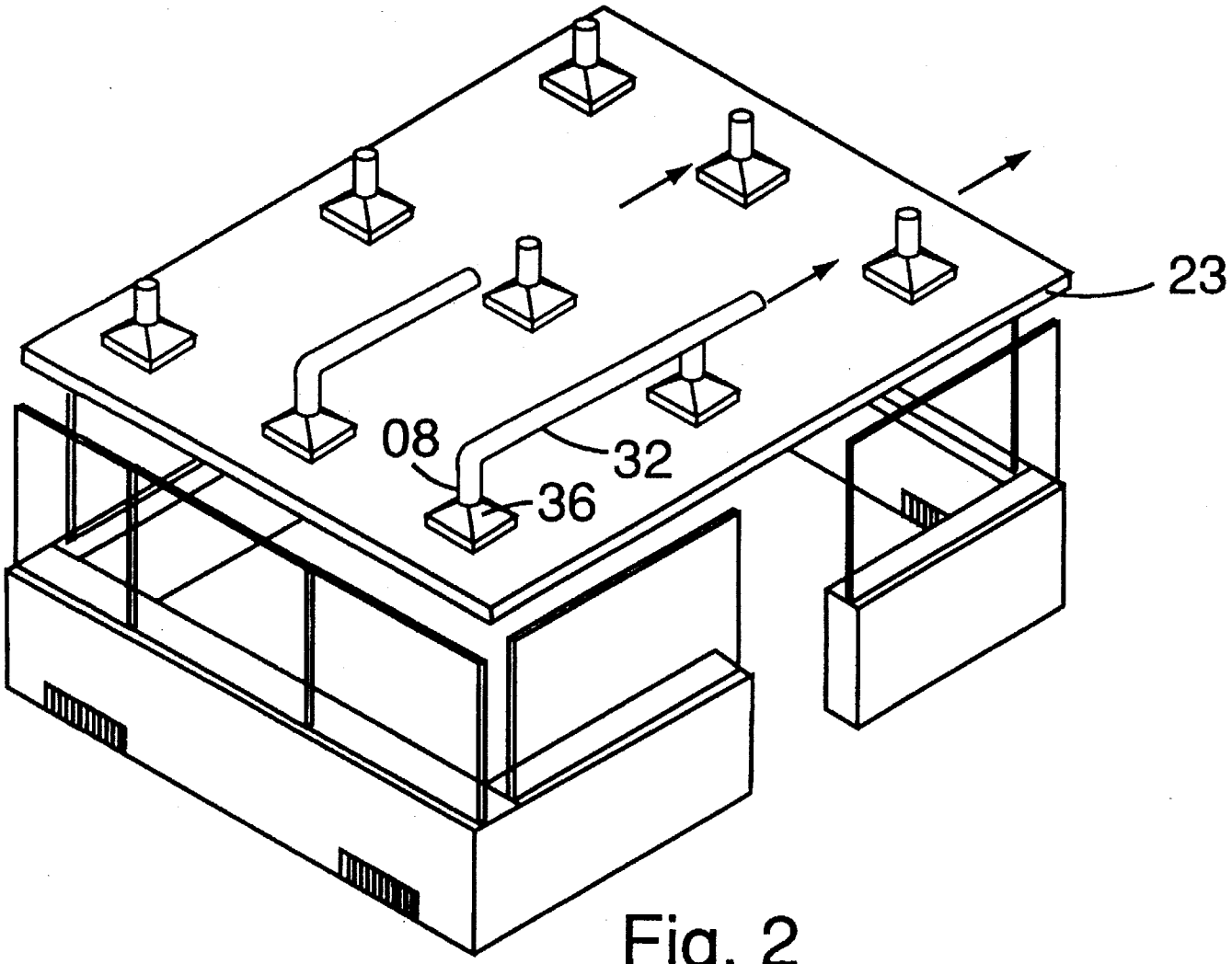
FIG. 2 is an isometric view of the enclosure and the associated duct arrangement.

The base portion 24, which is similar to a knee wall partition, includes a plurality of vents 28 at the bottom as is shown in FIG. 2. The vents 28 allow for make up air to enter the smoking section. It should be noted at this point that the wall sections 20 are modular and are constructed so that they can be relocated if necessary. Of course, the ventilation ports 25, and associated ducts 32 must also be relocated.

Referring again to FIG. 1, the ventilation ports 25 include filtration means 34. In the preferred embodiment, an activated charcoal filter is used. A baffle 36 is mounted above the ventilation ports 25 to guide the air and the passive smoke towards the ducts 32. The baffle 36 has an opening 38 which is adapted to secure the duct 32 and provide an air tight coupling therewith.

The ducts 32 are arranged in rows as is shown in FIG. 2. Each row of ducting leads to a HEPA filtration unit. The function of the HEPA unit is quite well known in the art and will not be discussed here. In the preferred embodiment one 2000 cfm HEPA unit is used per 30,000 cubic feet. Each row of ducting 32 is coupled to a blower which operates to cause sufficient air movement to effectively evacuate the smoke laden air from the smoking section with no lateral drift of passive smoke. Also in the preferred embodiment a 3×3 ventilation port arrangement is considered optimal for a 25'×20' smoking section.

Figure 3:
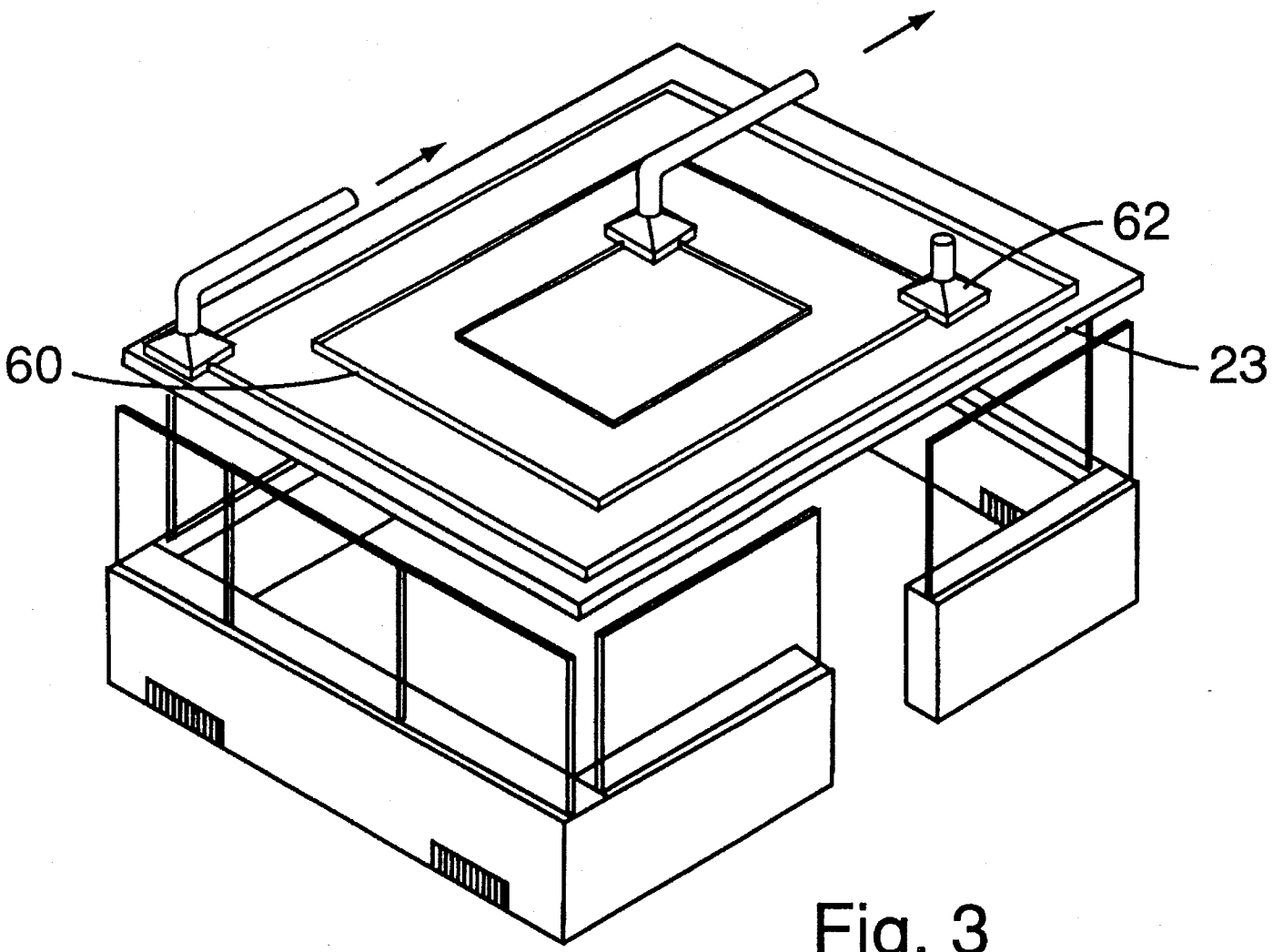
FIG. 3 is an isometric view of an alternative ventilation and ducting arrangement.

An alternative ventilation and ducting arrangement is shown in FIG. 3. In this embodiment, concentrically arranged apertured conduits 60 are mounted in the ceiling 23 in place of the array of ventilation ports 25. The apertured conduits 60, which have a plurality of apertures (not shown) formed therein, are arranged as concentric squares starting at the perimeter of the area above the enclosure 10. The conduits 60 all terminate at a node 62, the conduits 60 being connected to the node 62 so as to allow air to flow through to ducts 64. The ducts 64 lead to a HEPA filtration unit, blower, and exhaust port as in the previous embodiment. It can be readily appreciated that this arrangement requires signifigantly less ducting than the previous embodiment.

Figure 4:
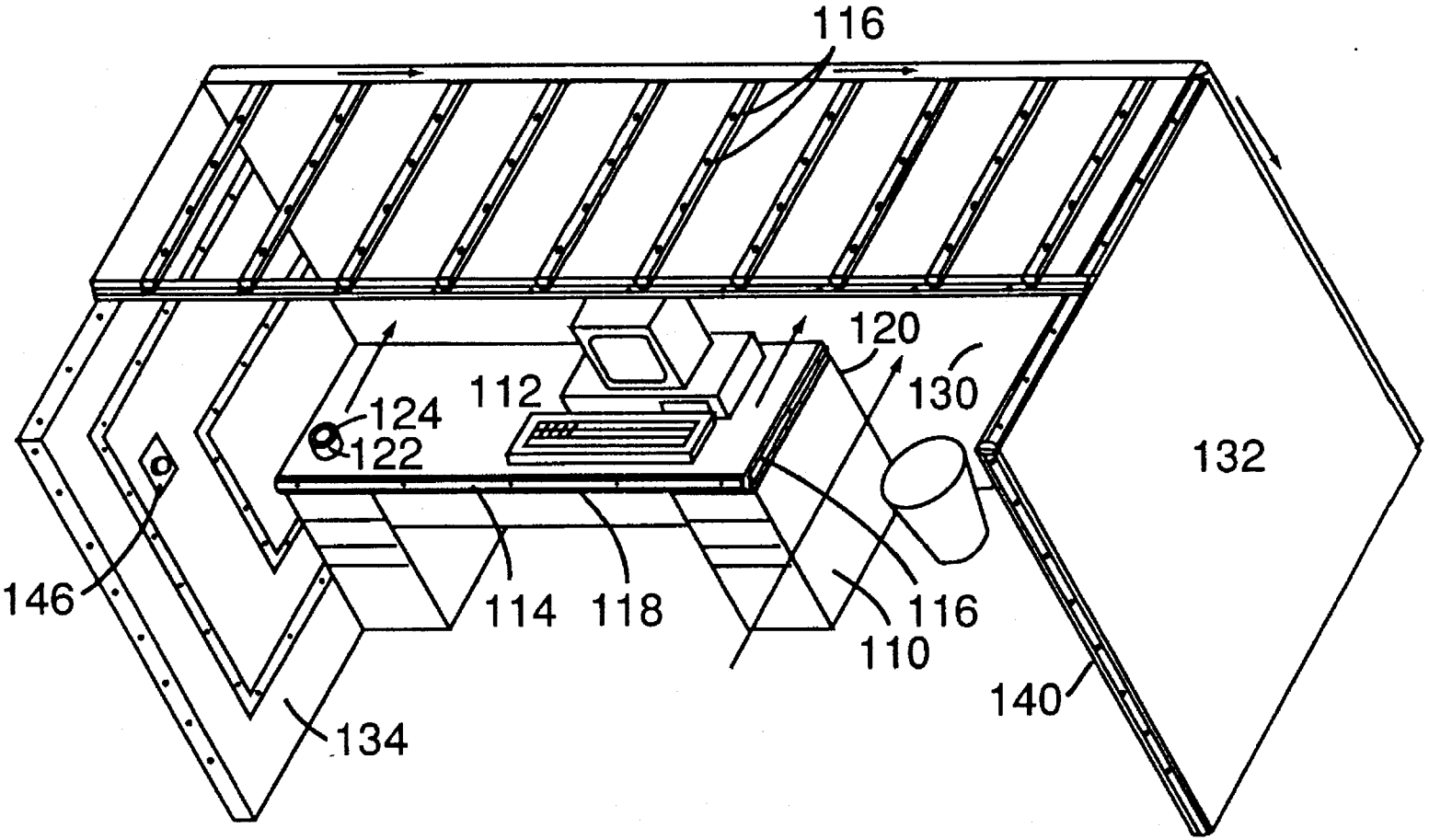
FIG. 4 is an isometric view of the enclosure of the second embodiment.
Figure 5:
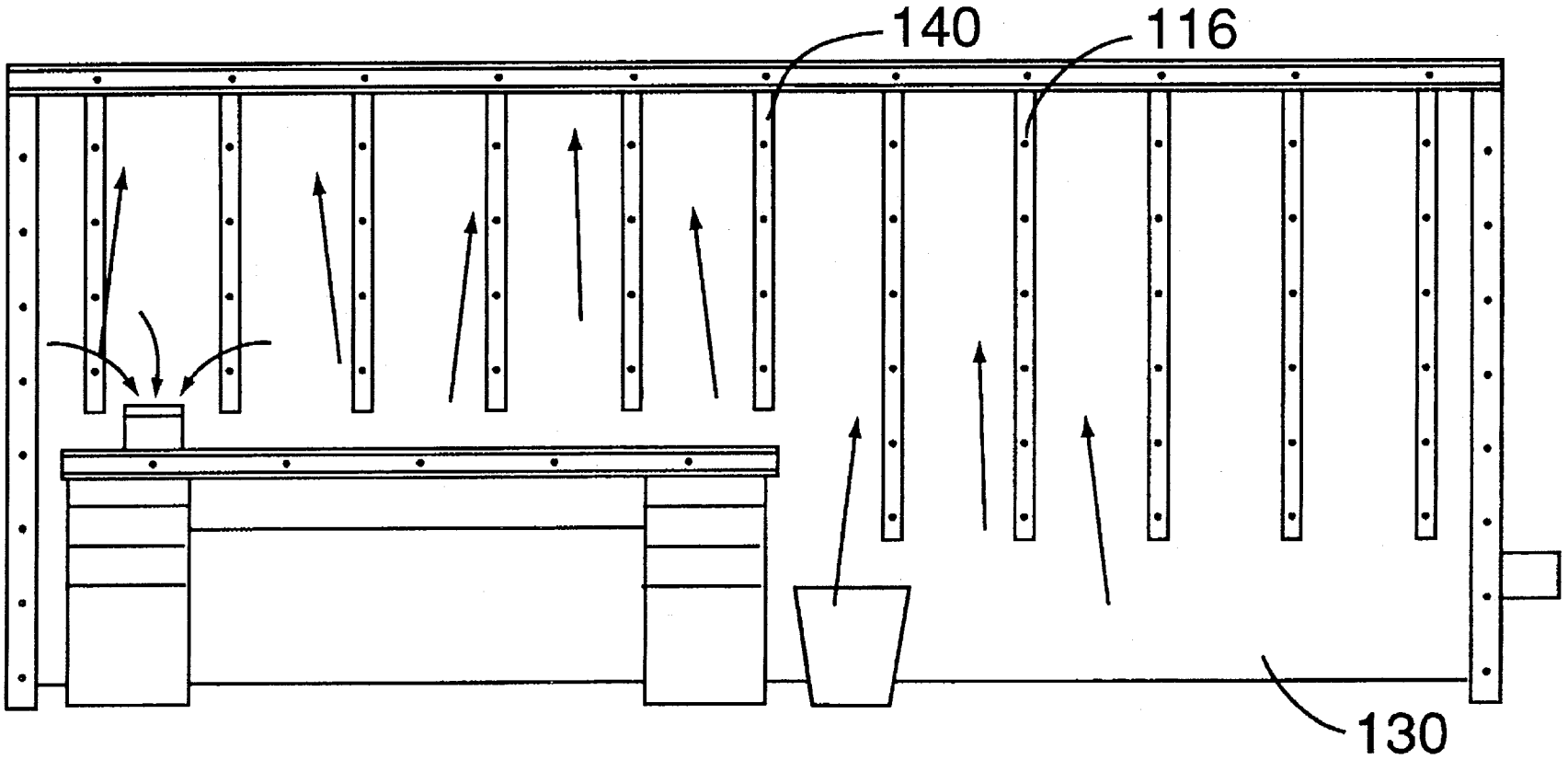
FIG. 5 is a front view of the enclosure of the second embodiment.

An alternative type of enclosure 100 is shown in FIG. 4. This type of enclosure 100 is adapted for use in the office environment. Enclosure 100 is modular and is designed in accordance with the traditional workstation configuration. A plurality of panels form a partial enclosure about the desk 110. The desk 110 has a top panel 112 which has front 114 and side 116 edges. The top panel 112 has an edge conduit 117 which has a plurality of evenly spaced ventilation apertures. The front 114 and side 116 edges have conduits, 118 and 120 respectively attached thereto. Conduits 118 and 120 have a series of evenly spaced ventilation apertures formed therein. Integral with the top panel 112 is ash tray 122. The ash tray 122 is connected to a seperate conduit (not shown) and includes a plurality of ventilation apertures 124 disposed about the circumference, the apertures being operably connected to the conduit to provide air flow to the rear panel 130.

Rear panel 130, along with side panels, 132 and 134, and top panel 136 form a partial enclosure which defines an isolated area which can contain passive smoke so as to prevent lateral drifting. The inner surfaces of the panels 130,132,134, and 136, all have rows of feeder conduits 140 attached thereto. The feeder conduits 140 have evenly spaced ventilation apertures 116 formed therein. Side panels 132 and 143 both have feeder conduits 140 and ventilation apertures 116 on their front and side edges. Top panel 136 has a feeder conduit 140 with ventilation apertures 116 on its front edge 144. Ventilation apertures 116 placed on the panel edges provide a final barrier to vertical as well as lateral passive smoke drift.

The arrangement of conduits 140 and ventilation apertures 116 on panel 132 is exactly the same as the arrangement of conduits 140 and ventilation apertures 116 on panel 134. Panel 132 also includes a variable speed control 146 which controls the speed of the blower (not shown). The feeder conduits 140 are arranged vertically as is shown in FIG. 4.

Figure 6:
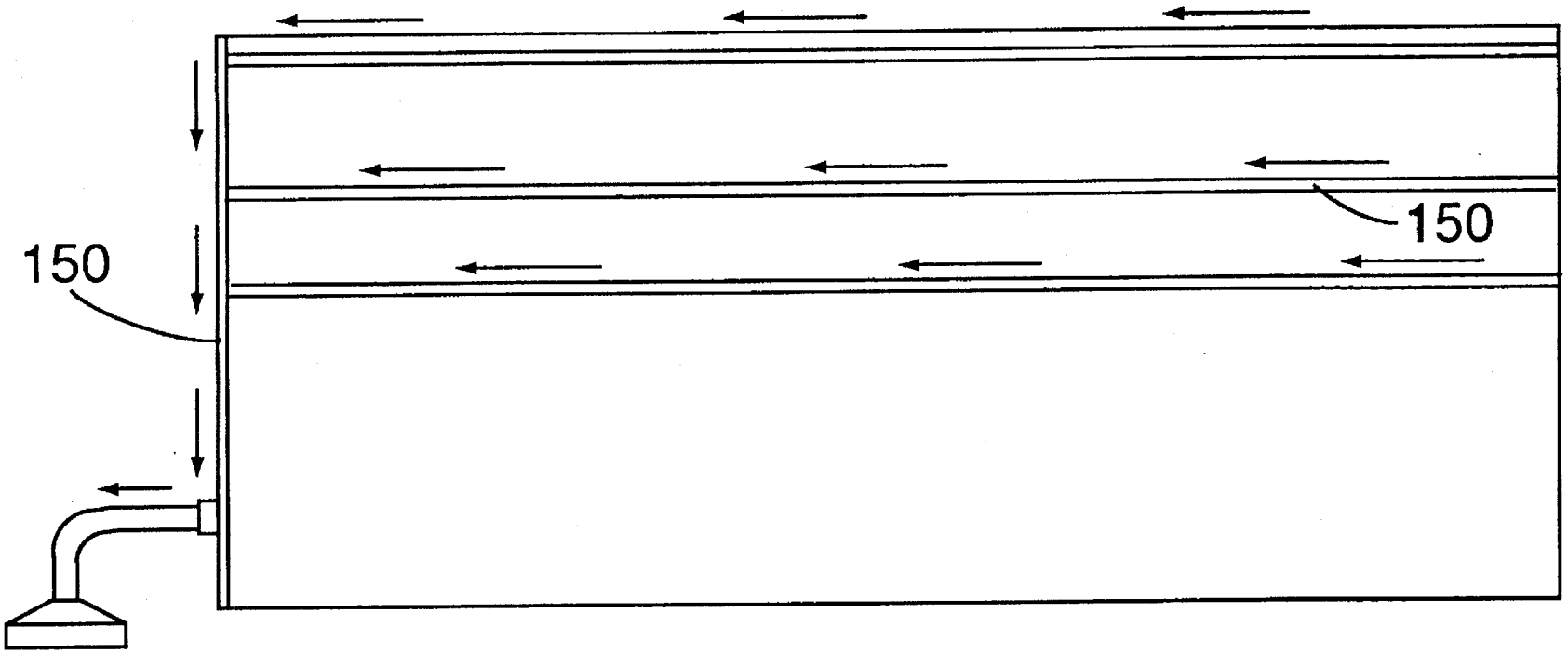
FIG. 6 is a rear view of the enclosure detailing the conduit arrangement.

Referring now to FIG. 6 a rear view of the enclosure 100 is shown. Main conduits 150 receive air flow from feeder conduits 140 and output it to exhaust port 152. A flexible duct 154 is connected to exhaust port 152 and conducts air flow through a HEPA filter unit (not shown). The blower is connected between the HEPA filter unit and an outdoor exhaust port (not shown).

In operation, the user can smoke anywhere inside of the isolated area defined by panels 130, 132, 134, and 136. Before starting to smoke, the user must turn on the blower using control 146. To increase the effeciency of the enclosure it is recommended that the user place the cigarette in the ashtray 122 when not inhaling. The passive smoke generated will be pulled in through ventilation apertures 124 and 116 along with the ambient air. The smoke laden air will travel through feeder conduits 140, and then through main conduits 150, out of the enclosure 100 through exhaust port 152, through duct 154, HEPA filter unit 156, before being exhausted to the outside.

What is claimed is:

1. A modular work station comprising:

a desk having a top surface, the top surface having front and side edges;

a partial enclosure having two side panels, a rear panel, and a top panel, said panels having an interior surface and an exterior surface, said panels defining an isolated area, the desk being located inside of said isolated area;

a plurality of ventilation apertures in said panels as well as on the front and side edges of the desk, said ventilation apertures operably connected to a network of conduit means for conducting air flow from said isolated area;

blower means operable to provide air flow succesively from said isolated area through said ventilation apertures, then from said ventilation apertures through said conduits to an outlet area.

* * * * *